US005473300A

United States Patent [19]

Watson

[11] Patent Number: 5,473,300

[45] Date of Patent: Dec. 5, 1995

[54] CABLE COUPLING TRANSFORMER

[76] Inventor: Michael B. Watson, 50 Churchfield Rd., Walton-on-Thames, Surrey KT12 2SY, Great Britain

[21] Appl. No.: 949,850

[22] PCT Filed: Mar. 27, 1991

[86] PCT No.: PCT/GB91/00459

§ 371 Date: Nov. 19, 1992

§ 102(e) Date: Nov. 19, 1992

[87] PCT Pub. No.: WO91/15022

PCT Pub. Date: Oct. 3, 1991

[30] Foreign Application Priority Data

Mar. 27, 1990 [GB] United Kingdom ..... 9006834

[51] Int. Cl.[6] ..... H01F 17/06

[52] U.S. Cl. ..... 336/175

[58] Field of Search ..... 336/155, 175, 336/184; 323/368

[56] References Cited

U.S. PATENT DOCUMENTS

| | | | |
|---|---|---|---|
| 4,021,729 | 5/1977 | Hudson, Jr. | 324/51 |
| 4,833,337 | 5/1989 | Kelley et al. | 307/11 |
| 5,220,297 | 6/1993 | Crowhurst | 333/32 |
| 5,233,318 | 8/1993 | Sasaki et al. | 333/109 |

FOREIGN PATENT DOCUMENTS

| | | |
|---|---|---|
| 0016458 | 3/1980 | European Pat. Off. . |
| 6140609 | 11/1991 | Japan . |
| 1441959 | 7/1976 | United Kingdom . |
| 2135031 | 9/1984 | United Kingdom . |
| 2175158 | 11/1986 | United Kingdom . |
| 2201055 | 8/1988 | United Kingdom . |
| 2201249 | 8/1988 | United Kingdom . |
| 86/06889 | 11/1986 | WIPO . |
| 88/02944 | 4/1988 | WIPO . |

*Primary Examiner*—Peter S. Wong
*Assistant Examiner*—Adolf Berhang
*Attorney, Agent, or Firm*—Patterson & Keough

[57] ABSTRACT

A cable coupling trandformer having a metal or ferrite member defining separate high permeability portions of a pair of flux paths, a winding electromagnetically associated with each high permeability portion, and a common low permeability portion of each flux path which passes between a pair of conductors carrying equal currents in antiphase. A portion of the current induced in either the conductors or the windings are impressed on the other to create a simple communications device.

15 Claims, 4 Drawing Sheets

CABLE COUPLING TRANSFORMER

This invention relates to a coupling transformer for a multi-core electrical conductor such as a twin core cable.

According to the present invention there is provided a coupling transformer for a pair of spaced electrical conductors bearing substantially equal and opposite currents, comprising a relatively high permeability member disposed in electromagnetic relationship with the conductors; the member, in use, defining a pair of flux paths and sharing a further portion, extending between the conductors, of relatively lower permeability; and a pair of electrically connected secondary elements each also disposed in electromagnetic relationship with a portion of the flux path defined by the high permeability member.

The transformer can be used to pick up or induce energy on a two or more core cable, such as a telephone cable, without making electrical contact with the cable provided the core conductors are spaced to permit the passage of flux between them. Thus, the invention provides a very simple tap into a multi-core cable without having to break the insulation or otherwise disturb the line.

When the transformer is used to pick up energy, e.g. signals, from the electrical conductors the secondary elements are arranged to provide antiphase outputs related to the current in the conductors. Conveniently, the secondary elements are connected together to provide an addition of the outputs. Commonly, the secondary elements are simply connected together so that the antiphase outputs are additively combined.

The device has many applications, for example, it could be used as a coupling for a plurality of burglar or fire alarm sensors to a common cable. Each sensor could be added to the common cable without having to break into it. Thus, sensors could be added or taken away as circumstances require.

A particularly useful application of this invention is as an extension tap on a telephone line or any signals around the audio frequency range up to high frequency and even radio frequency. The electromagnetic relationship between the flux path and the secondary elements can be according to conventional transformer coupling or by the Hall effect or a combination of both.

A particularly advantageous aspect of the invention is the fact that the arrangement of the two core cable effectively cancels noise picked up in the cable itself. The reason for this is that the opposed currents in the two cable cores induce a flux in the flux paths which result in a voltage induced in the secondary member, whereas noise picked up in both cores is substantially cancelled out.

The electromagnetic relationship between the flux path and the secondary elements is arranged to be by means of electromagnetic coupling, magnetoresistive coupling (the Early effect), the Hall effect or the like as will be apparent to the skilled person.

The cable coupling transformer according to the present invention can take many different forms while adhering to this general principle.

In one form of the invention the high permeability member may be an enclosure in the form of a frame or tunnel or an open channel having opposed limbs about which the electrical elements are wound in opposite senses. Ends of the windings may be connected such that an induced potential difference between the free ends is the addition of the voltages induced in both windings. In this, or any other embodiment, the windings may be equal, but this is not a strict requirement. For balance, the added outputs of the elements may be amplified appropriately if the outputs are initially unbalanced. Of course, the transformer works equally well in the opposite mode in which an electrical current in the windings induces a flux in each flux path and thence equal and opposite voltages in the cores of the cable. This is true of the invention as it is as a principle of transformers in general.

The enclosure or channel may be straight sided, i.e. rectangular in section, in which case the windings embrace opposed limbs. A tunnel arrangement of high permeability member is preferred to a simple frame as it provides greater coupling by virtue of the greater length of the cable in the tunnel.

Alternatively, the secondary elements may be constituted by the length of windings extending along the passage defined by the frame or tunnel in disposed electromagnetic relationship with the flux paths. The secondary elements may comprise a bundle of separately insulated wires. Particularly conveniently, the length of secondary elements may be constituted by opposite lengths of a single multi-turn coil, each side being disposed in electromagnetic relationship with the high permeability member.

In an alternative form of the invention the high permeability member is shaped to define a path for a loop of the cable core conductors. The path may be straight sided or arcuate. In either case, the secondary elements are constituted by coil windings adjacent either flat face of the loop. The flux path is defined by the high permeability member constituted by a shell or housing for the loop and windings and a high permeability core around which the loop is disposed. The housing also forms a screen to interference which may otherwise be picked up on the secondary elements. The shell is advantageously split about its circumference to allow the loop or cable to be inserted about the core.

In another form of the invention more than one turn of the loop of spaced conductors is wound around the core.

The enclosure or tunnel profile previously described provides flux paths which meet at a common portion constituted by the said further lower permeability portion which passes between the electrical conductors. In order to be able to lay the conductors in the tunnel it is necessary either to thread it through the tunnel aperture or partially to dismantle the tunnel and lay the conductors in it before closing it again. As a practical matter a twin-core cable, for example, already in use will be more easily supplemented with a transformer according to the invention by partially dismantling the tunnel assembly in order to avoid disturbing the line more than necessary.

To overcome this problem which may arise in some applications it is also found that the relatively high permeability member does not have to constitute at least a part of the region where the two flux paths converge. Instead, the ends of the high permeability members can be left unconnected so that the remaining flux path before the common portion is of a lower permeability, for example, an air gap. In this way the space for receiving the cable is open on one lateral side so that it may simply be laid in the channel defined between the two opposed limbs of the high permeability member.

It will be appreciated that this will result in a degradation in flux, but it is found that this is tolerable in many situations. Importantly, the noise cancelling qualities of the invention are substantially mantained.

The present invention can be put into practice in various ways some of which will now be described by way of example with reference to the accompanying drawings in which:

FIG. 1 is a schematic diagram of a first embodiment of the invention;

FIGS. 2(*a*) and (*b*) are a section and perspective view respectively of a second embodiment of the invention;

FIG. 3 is a section of a modified form of the invention in FIG. 2(*a*);

FIGS. 4(*a*) and (*b*) are a section and end view respectively of a third embodiment of the invention;

FIGS. 5(*a*) and (*b*) are a section and side view of a modified version of the embodiment of FIGS. 4(*a*) & (*b*);

FIGS. 6(*a*) and (*b*) are a scrap section perspective view and a plan view of a further embodiment of the invention;

It will be known to the skilled person that a current flowing in a conductor induces a magnetic flux in a ring of high permeability surrounding the conductor. Furthermore, a pair of co-axial conductors carrying equal and opposite currents will lead to cancellation of the flux.

If the conductors are separated, a pair of opposite flux paths are defined by the ring and the lower permeability route passing between the two conductors. The shared portion between the conductors carries a substantially smaller flux than would be created by a single conductor carrying the same current inducing the flux in the ring. However, the amount of flux is not negligible. It consists of the flux from both paths flowing in the same direction through this common portion between the conductors when the currents in the conductors are opposite.

Figure 1:
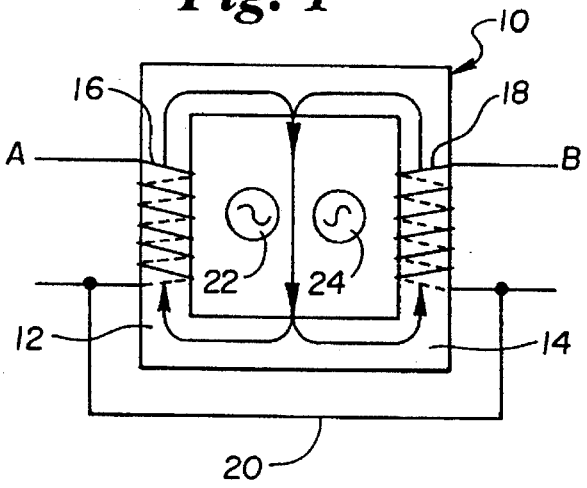

Referring firstly to FIG. 1, a first form of the invention is illustrated in which a high permeability, for example, steel, straight sided ring 10 is embraced on opposed limbs 12 and 14 by coils 16 and 18. The coils are wound in opposite senses about the opposed limbs. The lower ends of the coils are electrically connected together by a wire 20. The upper ends carry terminals A and B.

An electrical cable having two enamelled core conductors 22 and 24 passes through the ring. When equal alternating currents in antiphase are passed through the cable cores a magnetic flux is induced in the ring having flux paths of opposite senses (as indicated by the arrows) passing between the cores 22 and 24. This induces a voltage in each of the windings which are additively combined by the electrical connection constituted by the wire 20, such that a voltage proportional to the two equal and opposite currents in the conductors is produced between the terminals A and B.

Figure 2A:
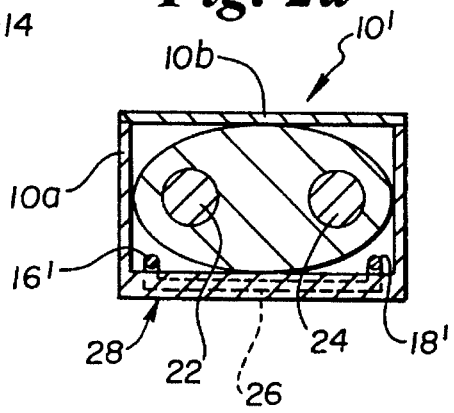
Figure 2B:
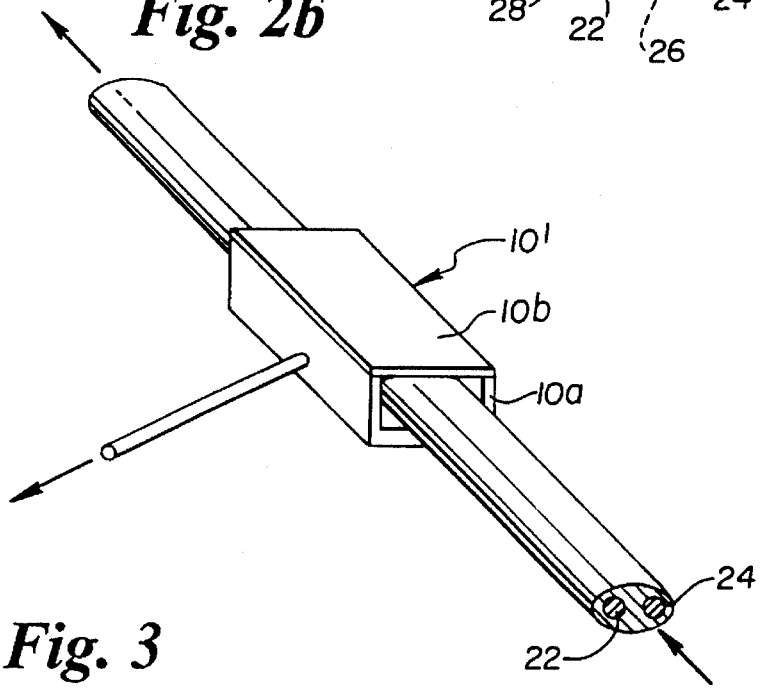

In an alternative form, the windings 16 and 18 are replaced by lengths of bundles of wires in the opposed corners of a tunnel $\mathbf{10^1}$ having a rectangular section to either side of the cores 22 and 24. This form is illustrated in FIGS. 2(*a*) and 2(*b*). The tunnel $\mathbf{10^1}$ comprises a channel portion 10*a* and a lid portion 10*b*. In the embodiment shown in the figures the lengths of secondary element are constituted by straight parallel sides of a coil 28. It is preferable that the connection portions 26 are disposed generally at 90° to the cable conductors in order that they do not receive an induced voltage themselves. These connecting portions are embedded in a recess in the channel 10*a* to take them out of the path of the cable.

Preferably, the straight lengths of the coil in the tunnel $\mathbf{10^1}$ are embedded in a relatively magnetically inert substance, such as epoxy resin.

The limitation on efficiency in this invention is rooted in the size of the air gap or other low permeability common flux path between the cables. Thus, the efficiency may be increased by inserting a spacer of higher permeability material in the air gap. Also, the shape of the tunnel could be modified by reducing the size of the side walls to minimize the air gap.

Figure 3:
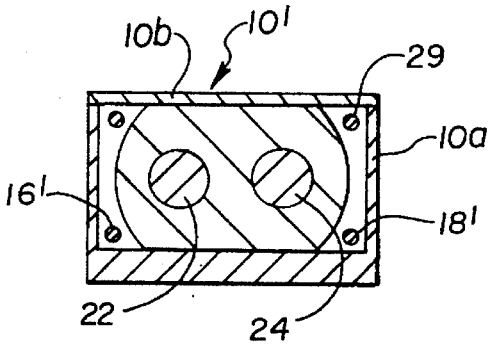

As shown in FIG. 3 a further winding 29 could be added in the free space between the lid and the side walls. This could be connected to increase the voltage proportional to the current in the conductors. However, the addition of this extra winding constitutes a further complication in assembling the device and connecting the two coils together.

The core constituted by the tunnel $\mathbf{10^1}$ is preferably laminated along the direction of the cable.

Figure 4A:
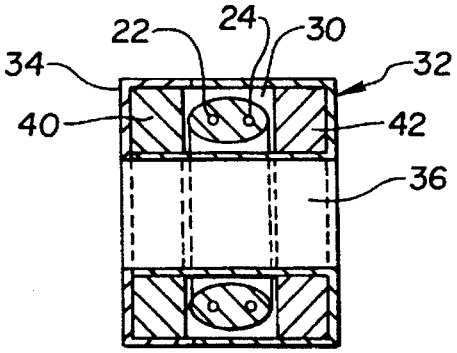
Figure 4B:
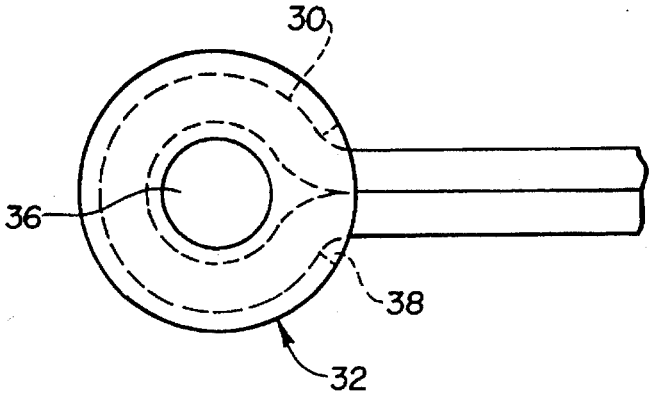

In an alternative form of the invention illustrated in FIGS. 4(*a*) and (*b*), the cable is looped inside a circular passage 30 of 12 mm diameter defined in a housing 32 having a high permeability outer portion 34 and a central core 36 of 5 mm diameter and 17 mm long. The outer portion 34 is formed with a hole 38 through which the loop passes to enter the housing and embrace the central core. The housing may be any other desired shape, such as straight sided in the manner of a rectangular box.

Connected coils 40 and 42 of about 2,500 turns of 40 s.w.g. wire are wound on either side of the loop of cable about the central core 36.

The flux path is defined by the housing and the substantially lower permeability path between the core conductors and through the central core 36. The central core serves as an insert of relatively higher permeability material which increases the permeability of the common path.

Also to enhance the efficiency of this loop-type coupling transformer the circumference of the core could be increased in order that a greater length of cable is required to embrace it.

Figure 5A:
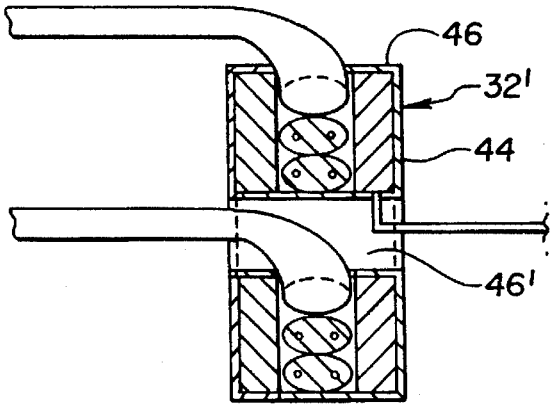
Figure 5B:
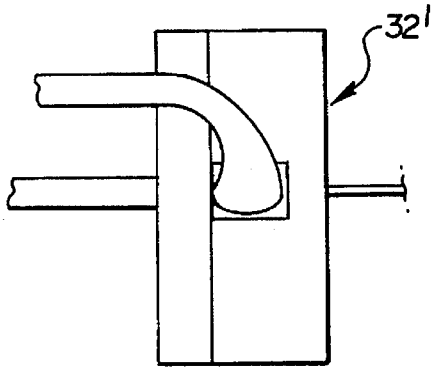

In FIGS. 5(*a*) and (*b*) an alternative form of the invention shown in FIGS. 4(*a*) and (*b*) is shaped to accommodate more than one turn of the cable. A hole $\mathbf{46^1}$ in the central core allows the cable in centrally. Again, the housing $\mathbf{32^1}$ is split into a lid and a bowl 44 and 46 to allow access to the inside thereof.

In yet another form of the invention the high permeability member is made up of a pair of E-shaped laminations facing one another such that their outer and middle limbs define rectangular spaces around which coils are wound on either side of a space to accommodate the loop of cable. In this particular form it will be appreciated that the air gap constituted by the hole through the central core described above is effectively filled by the central limb of the E-shaped plates. Indeed, this form of the invention can be considered as being similar to the sectional view of the invention in FIG. 4(*b*).

In the embodiment of FIG. 1, it is found that there is a substantially null region where the two flux paths meet before entering the air gap, for example, between the cable conductors. This can be exploited to create a form of the invention in which the space for the cable is an open channel in which the cable can be laid, as opposed to an enclosing tunnel.

Figure 6A:
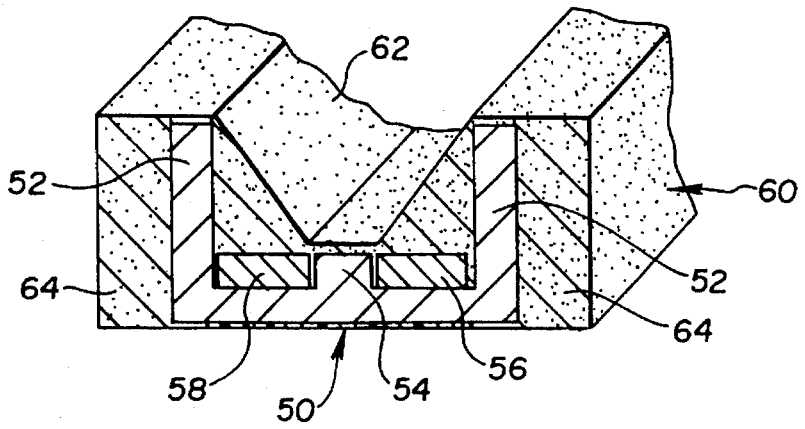
Figure 6B:
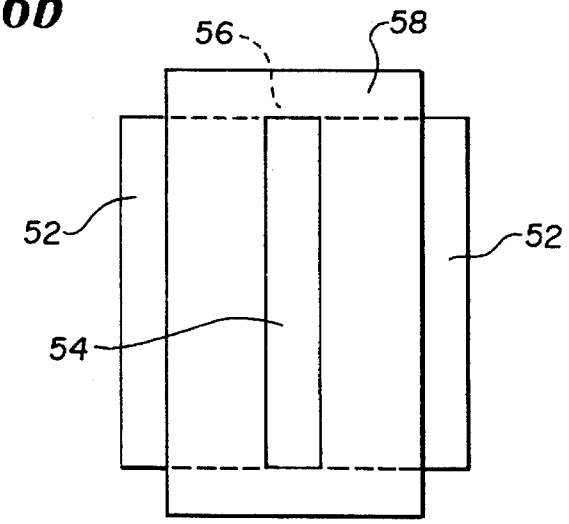

Referring to FIGS. 6(*a*) and (*b*) a further embodiment of the invention exploits this null flux region phenomenon.

The coupling transformer of FIGS. 6(*a*) and (*b*) comprises a former 50 made up of nickel steel or transformer quality steel laminations having E-shaped lateral profiles.

The profile is 25 mm wide, each outer limb 52 has a lateral thickness of about 2.5 mm. The inner shorter limb 54 is about 5 mm wide. The former is about 48 mm long. A winding 56 of 7000 turns of enamelled 50 s.w.g. copper wire is wound on a bobbin 58. This bobbin 58 embraces the inner limb 54 of the former 50.

This transformer construction is cast in a styrene resin forming a body 60 which defines a flat bottom V-shape channel 62, the base of which is just above the free end of the inner limb 54. The sides of the V-shape channel rise up to the inner edges of the tops of the outer limbs 52. The transformer in the resin casting is enclosed in a brass case (not shown) to provide electrostatic and/or electromagnetic screening. Of course, any other form of screening may be provided that will be known to the skilled person.

Figure 7:
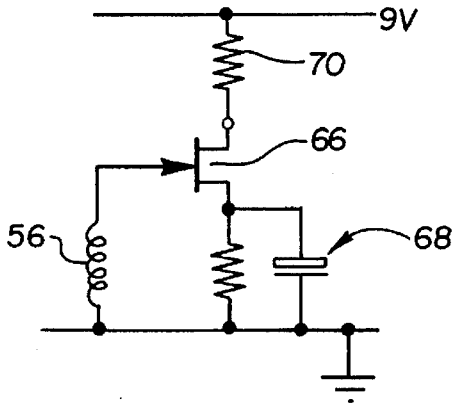
FIG. 7 is a circuit diagram of an amplifier for use with the invention.

It will be noted in FIG. 6(*a*) that the resin defines a pair of flanks 64 which extend laterally from the outer faces of the limbs 52. These contain amplification circuitry to which the ends of the winding 56 are attached. The circuit is shown in FIG. 7. The amplification is achieved by means of a BFW 10 field effect transistor 66. The winding 56 is connected between the gate of the transistor 66 and ground. The drain of the transistor 66 is connected to a voltage supply rail through a 4.7 kohm biassing resistor 70. This biassing resistor 70 may be remote from the transformer and not encased in the resin. The source of the transistor 66 is connected to ground through a 2.2 kohm resistor and 22 microfarad capacitor pair 68 connected in parallel.

Thus, the embodiment of FIGS. 6(*a*) and (*b*) is a self-contained receiver unit. Of course, the unit is also capable of transmitting if the internal amplifier is by-passed and a suitable impedance match is achieved using an external driver amplifier. However, the large air gap creates large transmitting losses making it less efficient and more prone to noise pick-up.

A twin core cable is placed on the bottom of the V-shaped channel 62 with the core conductors lying side-by-side. However, it is found that adequate pick-up is achieved if the cable is slightly relatively rotated and/or raised above the bottom of the channel. The V-shape of the groove is also found to be particularly advantageous in that cables of various diameters and different cross-sections may be centred relative to the inner limb of the former. As this construction of coupling transformer does not demand that the core conductors are located at the very bottom of the channel, the differing positions of the conductors in varying cable sizes has no marked effect on performance.

Figure 8:
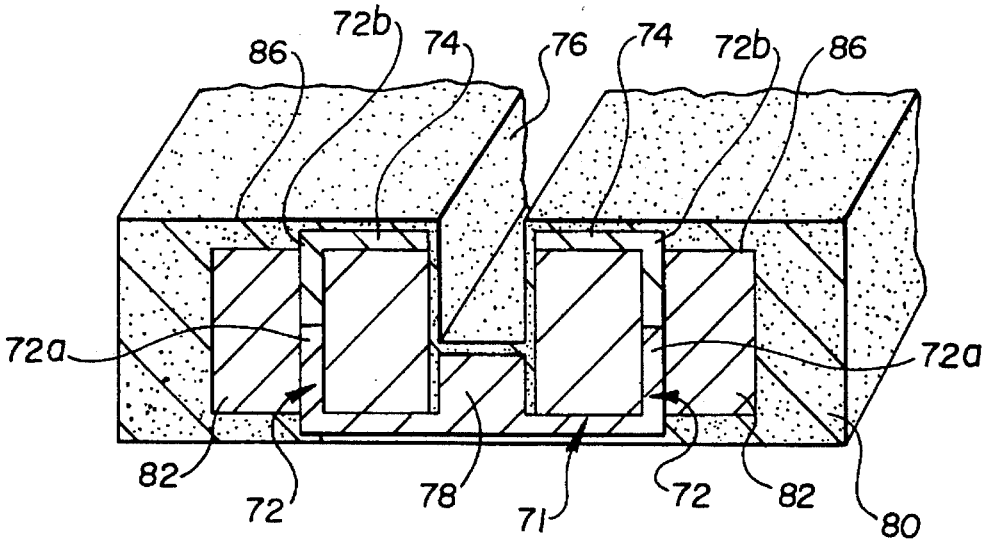
FIG. 8 is a scrap section perspective view of a another embodiment of the invention.

FIG. 8 illustrates a further embodiment of the invention that is particularly well suited to act as a transmitter. In this embodiment the former 71 is made up of lateral laminations of a modified E-shape profile of nickel steel or transformer steel in which the outer limbs 72 are formed with inwardly extending projections 74 that define the edges of a square channel 76 above an inner limb 78. As before, the outer limbs 72 are 2.5 mm wide and the inner limb is 5 mm wide. The outer limbs are 20 mm high and the longitudinal extent of the former is about 75 mm. As with the immediately previous embodiment, the assembly is encased in a surrounding styrene resin casting 80. Of course, any other suitable resin such as acrylic or epoxy will be equally applicable. Indeed, any suitable potting compound. Each outer limb has a winding 82 of 100 turns of 24 s.w.g. enamelled copper wire on bobbins 86 which are connected to the amplification circuitry to provide an additive signal of the anti-phase current in the windings. The windings in this embodiment are connected in parallel instead of series to reduce the impedance of the device at a drive amplifier connected to the windings.

For ease of manufacture the outer limbs are split into a first part 72*a* connected with the base portion of the former and a separate second part 72*b*. In assembly this allows each bobbin 86 to be placed on its respective first part 72*a* of the outer limbs and the second part 72*b* is then placed inside the inner gap in the bobbin. Again, the assembly can be encased in an electrostatic screen if necessary.

It is found that the projections 74 minimise the relatively low permeability path in the channels while still leaving an open channel into which the cable can be placed. In order further to reduce the low permeability portion of the flux path, it would be possible to use an inverted V-shape channel flaring outwardly toward the base of the E-shape profile into which a oval shape cable could be inserted and rotated to be held in place. However, in some applications this may require the thicker cables to be threaded into the channel from one end. With the inverted V-shape the cable could thus be held in place.

Figure 9:
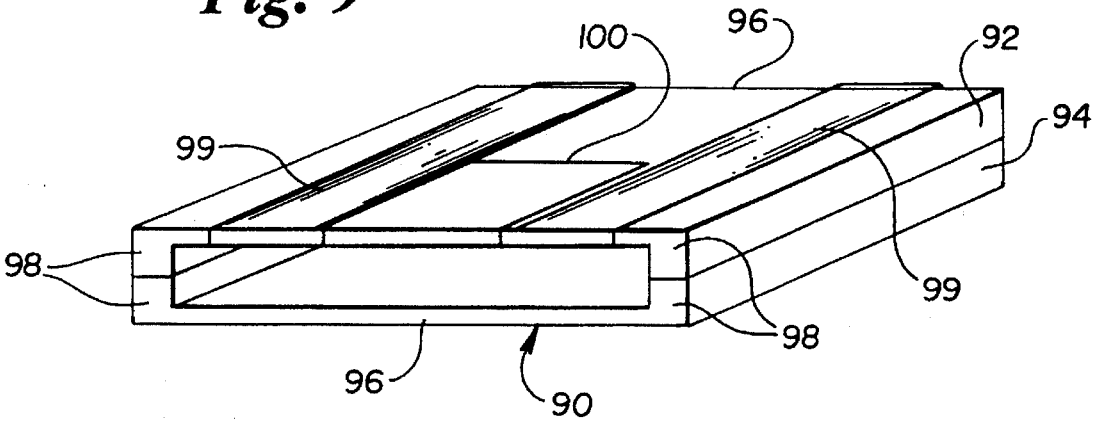
FIG. 9 is a perspective view of a further embodiment of the invention.

A still further embodiment of the invention is illustrated in FIG. 9. This is intended as a send/receive device for two-way communication on a shorted line. This embodiment consists of a two-piece former 90 made of ferrite material. The two halves 92 and 94 each comprise a flat base portion 96 of 60 mm×28 mm×6 mm and a pair of opposed 1 mm high side members 98. The respective side members 98 of each half meet together in the assembled device to create a tunnel through which the shorted line passes. As depicted in the drawing, the upper base portion 96, as shown, is wound with two connected groups of 15 turns each of closely spaced enamelled 20 s.w.g. copper wire windings 99 in a single layer. The windings 99 are wound in relatively opposite senses and connected by a bridging portion of wire 100 which is normally disposed with respect to the turns of the windings substantially to eliminate its influence on the conductors extending through the tunnel defined by the former 90.

In this embodiment, the relatively high permeability path is clearly defined by the ferrite former 90. As mentioned above, the flux paths in the former converge between the windings 99 and create a null region. The relatively low permeability part of the flux path passes between the bases 96 and between a correctly positioned cable in the tunnel.

Figure 10:
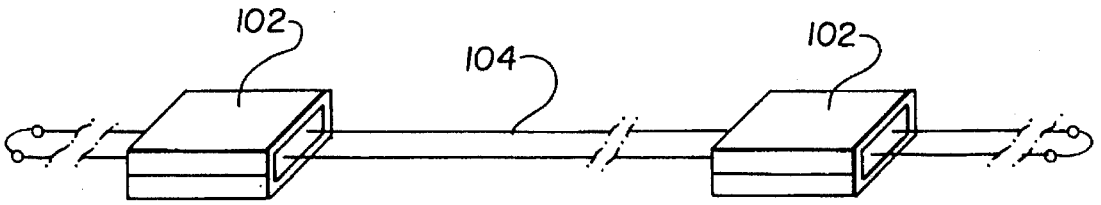
FIG. 10 is a schematic diagram of a communications system incorporating the invention.

An illustration of a send/receive communication system utilising the embodiment of the invention in FIG. 9 is illustrated in FIG. 10. The system comprises a pair of coupling send/receive units 102 as illustrated in FIG. 9 embracing a 300 ohm balanced twin core feeder cable 104 which is shorted at both ends. The cable is spaced in the tunnel of each device by spacers so that the centre of the relatively low permeability flux path substantially coincides with the gap between the feeders. The send/receive units have been spaced by more than 100 metres with good signal reception at 2 MHz transmission frequency after appropriate remote amplification. It will be appreciated that many more than the two send/receiver units can be mounted on the same line to equal effect. The number of units does not degrade the system performance substantially. The main factor affecting signal strength is the distance between the send and receive units.

The high frequency applications of this invention are also extendable to radio frequency communications with appropriate choices of material and construction of the coupling transformer while still adhering to the basic principals of the invention.

The system can be used for voice communication, signalling, remote control/telemetry and data transmission/reception. The term 'communications' is intended to embrace all these. While the invention is adaptable to many environments and applications on land, it is also the case that it is particularly well suited to under sea communications in which the relatively low permeability portion of the flux path will be made up largely of water. In this regard it is necessary to redesign the construction of the transformer in order to optimise its performance to take account of the differences in permeability between air and water. However, it is found that the same unit will work acceptably well in both environments.

The particular advantages of the invention of being very simple in construction and requiring only to be placed in a correct relationship with a plurality of wires carrying energy or onto which energy can be impressed make it of particular advantage under water where the problems of water engression and the relative lack of dexterity of a user of the device are particularly acute.

The invention is also well suited to hostile or corrosive environments for remote sensing of information/activity in a multi-core cable. Again, the simplicity of the coupling transformer as a communications device is of particular advantage.

Thus, the invention exploits a flux path between spaced conductors carrying equal and opposite currents to derive a voltage which is proportional to the currents in each conductor.

I claim:

1. A coupling transformer for a pair of spaced electrical conductors bearing substantially equal and opposite currents, comprising a relatively high permeability member disposed in electromagnetic relationship with the conductors; the member, in use, defining a pair of flux paths and sharing a further portion, extending between the conductors, of relatively lower permeability; and a pair of electrically connected secondary elements each also disposed in electromagnetic relationship with a portion of each of the flux paths defined by the high permeability member.

2. A transformer as claimed in claim 1 in which secondary elements are electrically connected so that outputs therefrom are additively combined.

3. A transformer as claimed in claim 1 in which the electromagnetic relationship between the flux path and the secondary elements is arranged to be by means of electromagnetic coupling electroresistive coupling or the Hall effect.

4. A transformer as claimed in claim 1 in which the high permeability member at least partially defines a space in which the conductors are disposed.

5. A transformer as claimed in claim 4 in which the high permeability member at least partially defines a tunnel surrounding the conductors or an open channel, the tunnel or channel including a portion of the flux path extending between the conductors.

6. A transformer as claimed in claim 5 in which the channel has a substantially V-shaped profile.

7. A transformer as claimed in claim 5 in which the tunnel or channel is straight or arcuate.

8. A transformer as claimed in claim 1 in which each secondary element is constituted by an electrical conductor associated with a portion of the high permeability member each portion bearing the flux path of a respective one of the electrical conductors.

9. A transformer as claimed in claim 8 in which each of the secondary elements are constituted by a winding.

10. A transformer as claimed in claim 9 in which each winding is wound around the corresponding portion of flux path.

11. A transformer as claimed in claim 1 in which a high permeability insert is disposed in part of the portion of the flux path extending between the conductors between the high permeability member and the conductors.

12. A transformer as claimed in claim 1 in which the relatively high permeability member constitutes a former of laminated steel or solid ferrite material.

13. A transformer as claimed in claim 1 including an amplifier circuit having an input connected with the pair of secondary elements.

14. A communications system comprising at least one coupling transformer as claimed in claim 1 and a twin core conductor cable disposed such that the low permeability portion of the flux path passes substantially between the conductors.

15. A system as claimed in claim 14 in which the cable is a pair of conductors shorted at both ends.

* * * * *